US005492047A

United States Patent [19]

Oliveri

[11] Patent Number: 5,492,047

[45] Date of Patent: Feb. 20, 1996

[54] SOUND MUFFLING, TONE MAINTAINING DRUM PRACTICE APPARATUS

[76] Inventor: Ignazus P. Oliveri, 4 Gale Rd., Oakdale, N.Y. 11769

[21] Appl. No.: 326,547

[22] Filed: Oct. 20, 1994

[51] Int. Cl.[6] ..... G10D 13/02

[52] U.S. Cl. ..... 84/411 M; 84/411 P

[58] Field of Search ..... 84/411 M, 411 P, 84/DIG. 12

[56] References Cited

U.S. PATENT DOCUMENTS

| | | | |
|---|---|---|---|
| 3,453,924 | 7/1969 | Glick et al. | 84/411 M |
| 4,242,685 | 12/1980 | Sanford | 343/770 |
| 4,242,937 | 1/1981 | Pozar | 84/411 M |
| 4,244,266 | 1/1981 | Hardy | 84/411 M |
| 4,519,288 | 5/1985 | Aluisi | 84/411 M |
| 4,577,541 | 3/1986 | Edge | 84/411 R |
| 4,589,323 | 5/1986 | Belli et al. | 84/411 M |
| 4,745,839 | 5/1988 | Peraino | 84/411 M |
| 5,062,341 | 11/1991 | Reiling et al. | 84/702 |
| 5,107,741 | 4/1992 | Beals et al. | 84/411 M |
| 5,115,706 | 5/1992 | Aluisi | 84/723 |
| 5,159,139 | 10/1992 | Beals et al. | 84/414 |

OTHER PUBLICATIONS

Remo USA Drum Head Catalog, copyright 1991, North Hollywood, CA 90605, "Legacy", p. 4.

Remo USA Drum Head Catalog, copyright 1991, North Hollywood, CA 90605, "Muff'l" p. 12.

H. Q. Percussion Products, St. Louis, MO 63143, "Real Feel", advertisement in Modern Drummer, Sep. 1994, p. 60.

H. Q. Percussion Products, St. Louis, MO 63143, "Silencers", advertisement in Modern Drummer, Jul. 1994, p. 16.

*Primary Examiner*—Cassandra C. Spyrou

*Attorney, Agent, or Firm*—Alfred M. Walker

[57] ABSTRACT

A removable practice apparatus for musical instruments, namely, a drum is provided and more particularly to a removable drumhead noise reducer having a double sided drumhead construction with a sound absorber therein, for positioning upon an existing drum, permitting drumstick practice to be played on top of the existing drum without losing the actual tactile feel and sound tone of an actual drum.

6 Claims, 2 Drawing Sheets

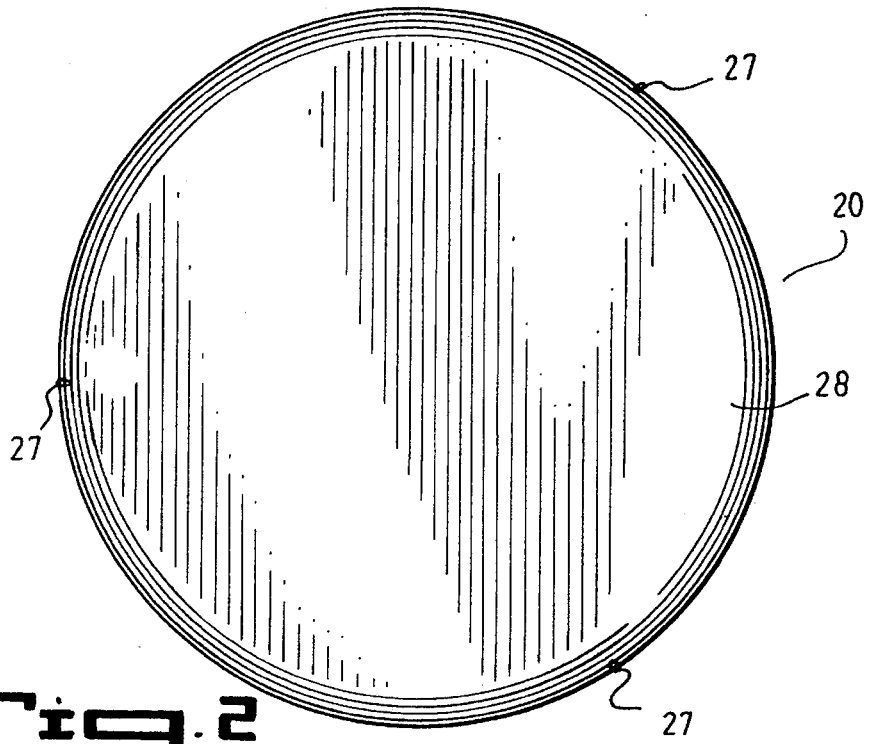
Fig. 2
Fig. 3
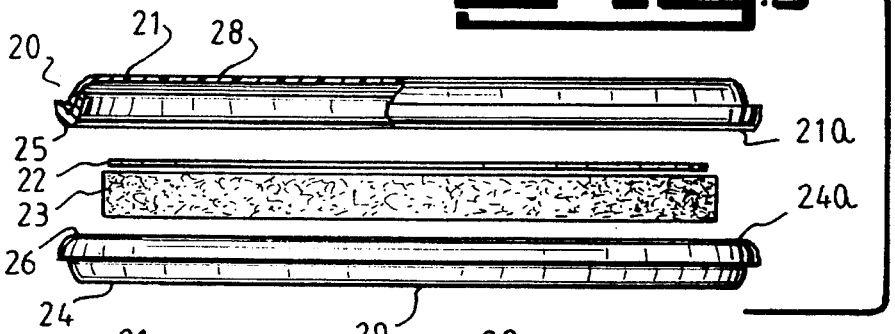
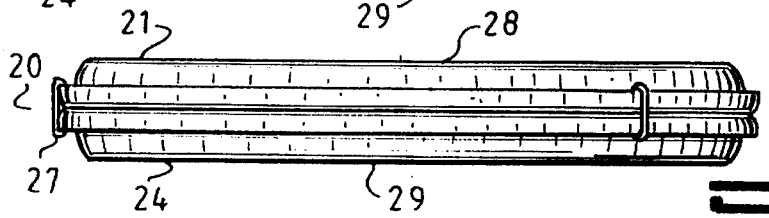
Fig 4

SOUND MUFFLING, TONE MAINTAINING DRUM PRACTICE APPARATUS

FIELD OF THE INVENTION

The present invention relates to a practice apparatus for musical instruments, namely, a drum and more particularly to a novel type of drumhead noise reducer sound box having a double sided drumhead construction with a sound absorber therein. The sound box is placed upon the top of a drumhead, thereby permitting drumstick practice to be played on top of actual drum without losing the actual tactile feel and sound tone of an actual drum.

BACKGROUND OF THE INVENTION

The prior art includes a conventional drum, which for convenience is shown as an example in FIG. 1. The conventional prior art drum generally has a construction as shown in FIG. 1.

For example, the prior art drum 15 includes a cylindrical drum shell 12 having a hollow recess 11 therein, a drumhead 13 disposed substantially parallel to an opposite drumhead 13*a* at a predetermined space and rims 14, 14*a* connecting the drumheads 13, 13*a* with the cylindrical drum shell 12, which with the drumheads 13, 13*a* and rims 14, 14*a* collectively form a drum 15. There are also provided tuning keys 16, 16*a* which connect and tighten rims 14, 14*a*, and therefore keep drumheads 13, 13*a* substantially flush with that of cylindrical drum shell 12.

Further with respect to the prior art drum 15, the boundary edge of rims 14, 14*a* extends beyond the planes of drumheads 13, 13*a*, which drumheads 13, 13*a* are stretched over the rims 14, 14*a*. The vibration waves of the top drumheads 13 being struck by the player's drumstick are transmitted through drumhead 13 and drum shell 12, causing the resultant resonant tones to be emitted from the drum. The musical tones produced are defined by the materials and diameters of the drumhead 13 used as well as by its tension resulting from adjustment by the tuning key 16. The types of musical tones produced are affected by the material, shape and size of the drum 15.

However, when used in a practice session, the conventional prior art drum as described aforesaid produces a considerable amount of undesirable raised decibel level of sound, which can be annoying to persons in the vicinity of the drum being played.

Therefore, the prior art also includes various efforts which have therefore been made to suppress noise level of drum playing during practice sessions. Among the prior art drum practice devices include that described in U.S. Pat. No. 5,115,706 of Aluisi for a plurality of drum pads with electronic synthesizer means.

U.S. Pat. No. 5,159,139 of Beals, assigned to Evans Products, Inc. of Dodge City, Kans., describes a drumhead with overtone suppression, comprising a drumhead sheet having outside surface and inside surface, which terminates in a peripheral ring on the inside surface of the sheet, wherein a plurality of holes are provided in the peripheral ring.

U.S. Pat. No. 5,107,741 also of Beals, and also assigned to Evans Products, Inc., Dodge City, Kans., describes a muffler for a bass drum including a hingably movable-pillow of a sound absorbing material, a mounting means hingably supporting the pillow inside a drumhead, wherein the pillow is displaced away from drumhead when drumhead is struck, and the pillow returns to inside of drumhead due to resilient urging of hinge against pillow.

U.S. Pat. No. 5,062,341 of Reiling describes an electronic drum sound simulator.

U.S. Pat. No. 4,745,839 of Peraino also describes a muffler inside a drum. U.S. Pat. No. 4,577,541 of Edge describes a spherical musical drum. Moreover, U.S. Pat. No. 4,254,685 of Sanford describes a drumhead with a particular membrane.

U.S. Pat. No. 4,519,288 of Aluisi describes a drum baffle system with a baffle to dampen drumhead vibrations. The baffle is mounted inside the drum shell and it contacts the drumhead. A second baffle within drum shell is perpendicular to the axis of the drum.

Furthermore, U.S. Pat. No. 4,242,937 of Pozar describes an electronic pickup assembly with a drum to amplify, not, muffle sounds.

Among known unpatented prior art devices, are "Real Feel" rubber practice mat attached to a wooden base, such as manufactured by H.Q. Percussion Products of St. Louis, Miss. 63143. However, with respect to sound quality, the "Real Feel" device produces a flat, non-vibrating, wooden tapping sound when struck by a drumstick. Also, with respect to the tactile touch, the "Real Feel" device causes a non-elongated, less repetitive response to the stick within the hand of the drum player.

Another known unpatented prior art device is the "Silencer" foam rubber pad, also of H.Q. Percussion Products. This device is a simple rubber pad disk which is placed directly upon the drumhead to muffle sound. However, with respect to sound, the "Silencer" produces a flat, non-vibrating thud type of sound when struck, and causes a flimsy, rubbering, non-vibrating response in the drumstick when struck.

In contrast, the present invention provides a portable practice aid placed upon the drumhead, which reduces sound and which imitates the full sound of the drum when struck, and causes a firm enlongated, repetitive rebound of the drumstick, as if playing a real drum.

For a drummer who knows how hard it is to practice without disturbing the people around him or her with high noise levels, the prior art practice pads reduce the noise decibels, but the prior art pads do not give the drummer the actual feel of playing a real drum.

Moreover, none of the prior art patents describe a portable practice pad which is placed upon a drumhead, and which significantly reduces the decibel volume of the drum sounds, while maintaining most of the sound tone and tactile feel of playing a real drum.

In contrast to the prior art, the noise reducing practice sound box of the present invention gives a drummer a real tactile drum feel and drum sound, without real drum decibel volume.

The practice apparatus of the present invention gives a drummer the drumstick and drumhead bounce and response of a real drum. The apparatus looks and feels like a conventional drumhead, and it provides the best way to practice drums without having to modify one's drum technique and without sound distortion.

It also enables a drum teacher and a drums student to communicate as the lesson is in progress without interrupting the lesson.

Moreover, the practice pad of the present invention is a valuable ear protection device.

The present invention produces a drum-like sound each time a drumstick taps against its surface, and more particularly it constitutes a drum sound simulator which is portable and may operate with or without the need for an actual drum.

The improved drumhead produces momentarily a change in the sound of a drum when the drum is struck. It includes a removable sound box including a pair of drumheads, and is specially constructed to suppress and muffle unwanted noise and vibrations without detracting from the tonal characteristics of drum playing.

By utilizing drumhead skins, the present invention does not alter significantly the feel of the drum and does not detract from the clarity and drumstick response of the drum sound when the head is struck by the drumstick. Inside the practice apparatus is a first layer of a sound absorbing material, topped by a second thinner layer pad, which two layers serve as mufflers to decrease the excess noise of the drum during a practice session.

The muffling apparatus of the present invention enhances the sound of a drum during practice, and suppresses unwanted noise, while imitating the sound and active feel of the drum. It absorbs sound with two muffler layers which are inserted within a recess between two oppositely opposed adjacent drumheads in order to provide the sound muffling effect.

OBJECTS OF THE INVENTION

It is therefore an object of the present invention to provide a drum practice apparatus having a portable drumhead configuration and a construction so as to permit realistic drum sound tones to be produced.

Another object of the invention is to provide a drum practice aid wherein the end portions of portable two drumheads are fixedly coupled, forming a recess to each other therebetween. Wherein a plurality of resilient substrates are placed within the recess adjacent to the inner sides of the respective drumheads, so as to mutually offset and reduce the bending moment applied to the upper drumhead by the drumstick over its outer surface.

It is also an object to improve over the disadvantages of the prior art.

SUMMARY OF THE INVENTION

In keeping with these objects and others, Which may be apparent, the present invention relates to a practice apparatus for musical instruments, namely, for a drum and more particularly to a novel type of drumhead noise reducer, having a double sided drumhead construction with a recess having a sound absorber layer therein, permitting drumstick practice to be played on top of actual drum without losing the actual tactile feel and sound tone of an actual drum.

DESCRIPTION OF THE DRAWINGS

The drum practice aid of the present invention can best be understood in conjunction with the accompanying drawings, in which:

FIG. 2 is a top plan view of the drumhead practice aid as in FIG. 1.

FIG. 3 is an exploded side elevational view in partial section of the drumhead practice aid according to an embodiment of the present invention as in FIG. 1; and FIG. 4 is a side elevational view according to the embodiment of the invention as in FIG. 1.

DETAILED DESCRIPTION OF DRAWINGS

Figure 1:
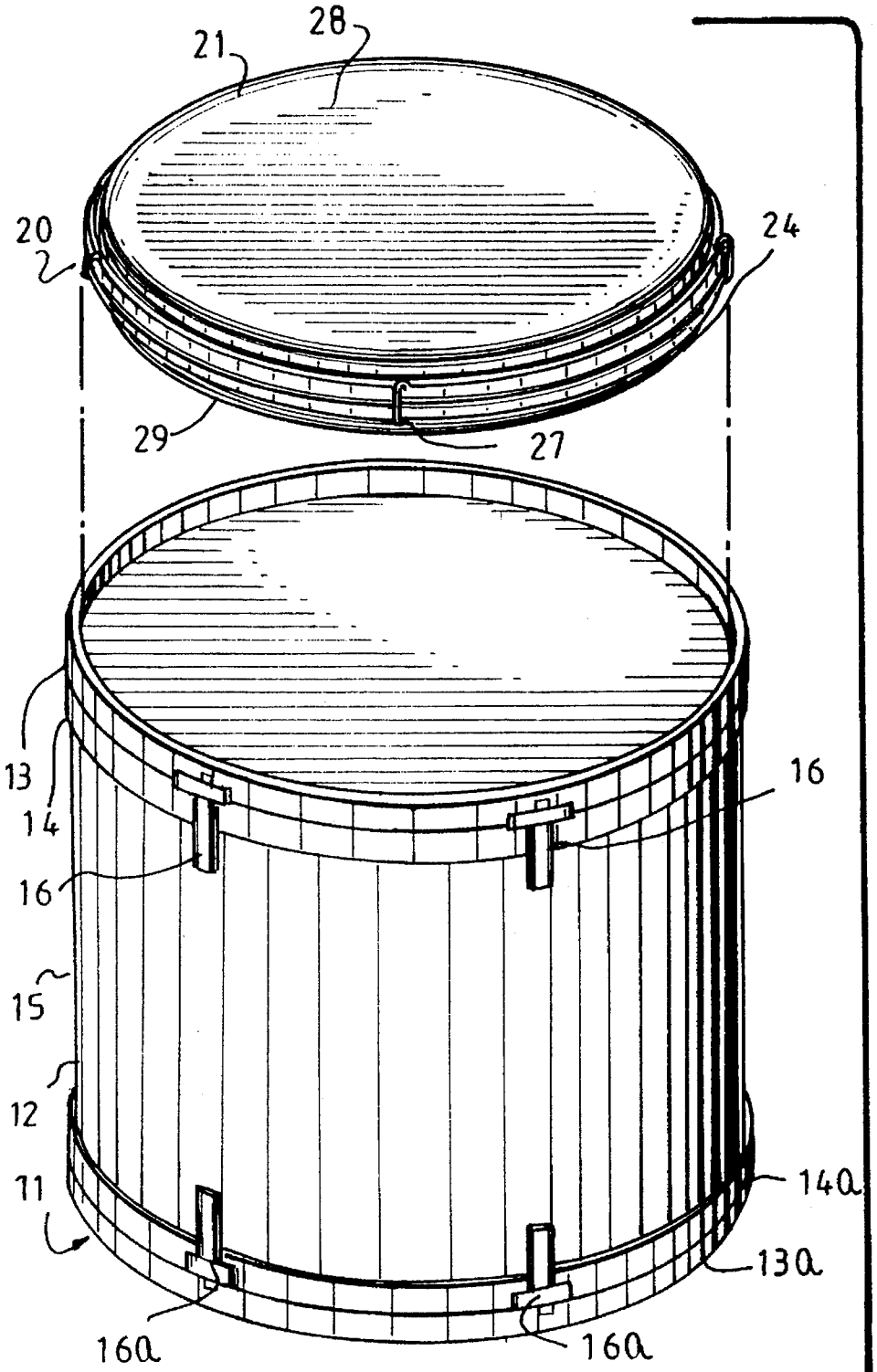
FIG. 1 is a perspective view of the drumhead practice pad of the present invention shown in an exploded view above a conventional drum.

There will now be described by reference to the appended drawings a drum practice aid according to the embodiment of the present invention.

FIGS. 1–4 represent a drumhead practice aid according to the invention.

As shown in FIG. 1, a drum practice aid 20 is placed upon a prior art drumhead 13 of conventional drum 15, as described aforesaid. Drumhead practice aid 20 includes two oppositely facing drumheads 21 and 24 having respectively substrate insert layers 22 and 23 therein. Drumheads 21, 24 are positioned adjacent and substantially parallel to each other and each has an edge 25, 26 respectively connecting these drumheads 21 and 24. The two oppositely facing drumheads 21, 24 constitute drum practice aid 20, which functions as a hollow sound box.

On the outer sides of the drumheads 21 and 24 are provided a plurality of latches 27. Latches 27 are fixedly connected to the edges 25, 26, of the two drumheads 21, 24, which drumheads 21, 24 extend substantially in the opposite directions in parallel relationship with their inner sides 21*a*, 24*a*, facing each other. Each drumhead 21 or 24 has at its inner side 21*a* or 24*a*, a surface which is substantially flush with either the top thin top substrate layer 22 or the bottom of thicker sound absorbing substrate layer 23.

The two drumheads 21, 24 are integrally joined together at the edges 25, 26. Drumskins 28, 29 are stretched over the drumheads 21, 24 respectively.

With the drumhead practice aid 20 of the present invention constructed as described above, there can be obtained varieties of drum sounding tones while significantly reducing the sound decibel levels of the drum 15 beneath practice aid 20. The vibration waves of upper drumhead skin 28 struck by the player's drumsticks are transmitted to the thin upper pad substrate 22 and thence into thicker resilient lower pad 23 to cause resonant and reduced volume tones to be given forth by the drumskin from the drum practice aid 20.

There can be obtained from the drum practice aid 20 drum-like tones having realistic drum tones resonating from the vibrating drumskin 28, on its played side 21, such as resembling those sounds of a real drum, but with a lower decibel level. Accordingly, the present invention enables a drummer to produce drum like sound tones at a reduced sound level.

The drumheads 21, 24 respectively are connected to each other, and are fixed joined together by a suitable fastening means such as latches 27.

A drumhead constructed according to the embodiment of the present invention not only imitates a drum sound, but also allows a user to practice on an actual drum 15 below drum practice aid 20.

A further advantage of the present invention is that the drumskins 28, 29 may be made with actual drumskins and a realistic performance is much more easily facilitated when the upper drumskin 28 is struck, causing the resonating sound to be muffled while travelling through inner substrate resilient layers 22, 23, so that only a portion of the vibrating sound waves contact lower drumskin 29 of lower drumhead 24, which thus causes a reduced vibration of the actual drum's drumskin 13 upon drum shell 12 of drum 15.

When the upper drumhead 21 is initially struck by a drumstick, the force of the pad substrate 22 against the underside 21*a* of drumhead 21 muffles the initial vibration of the drumhead 21. However, the force of the drumstick striking the drumhead 21 displaces the pad substrate 22 away from the drumhead into lower insulation pillow 23 of a shock absorbing material such as styrofoam. While the pad 22 is displaced from the drumhead 21, the vibrations of the drumhead are muffled.

The muffling device 21 is placed over the drumhead 13 of drum 15. Therefore, the muffling effect is consistent each time upper drumhead 21 is struck with the drumstick. At the same time, the "feel" of the drum is enhanced by the vibration of the muffling device.

It is noted that other modifications may be made to the present invention, without depicting from the spirit and scope of the invention, as noted in the appended claims.

I claim:

1. A removable drum practice aid for a drum having a top facing drumskin, comprising a hollow sound box formed of two oppositely facing drumheads, each having a drumskin thereon, said drum practice aid being removably positioned on said top facing drumskin of said drum, said drumheads being disposed at a predetermined space in substantially parallel relationship, each said drumhead having a side edge fixedly coupling said drumheads, each said side edge being adjacent to each other of said side edges, said drumheads and said side edges defining a sound chamber common to both of said drumheads; said hollow sound box further having at least one fastening means attached to said drumheads, said at least one fastening means closing said sound box; said sound box further having a plurality of sound absorbing resilient substrates disposed within said sound box, each said substrate having an outer surface substantially flush with one inside surface of said drumheads respectively, and each said drumhead having a drumskin stretched over each said drumhead.

2. The practice aid according to claim 1 wherein said drumskins of said drumheads extend in the opposite directions in spaced parallel relation to one another and each said drumhead terminates in said side edge being a linearly extending edge, each said drumhead being adjacent to each other drumheads at each of said edges.

3. The practice aid according to claim 1 wherein said drumskins of said drumheads extend substantially in the opposite directions in a parallel relationship with respective rear sides of said drumskins facing each other and said drumheads are fixedly and directly connected together.

4. A removable muffling device for a drum having a drum shell and a top facing drumhead on one end of the shell, said muffling device comprising:

said muffling device being removably positioned on the top of said top facing drumhead of said existing drum;

a pair of oppositely facing further drumheads defining a cavity recess therebetween, each said further drumhead being directly adjacent to each other of said further drumheads at least one first substrate layer comprising a sound absorbing material, said first substrate layer being within said recess, said first substrate being adjacent to an upper drumhead of said further drumheads, and, said sound absorbing substrate absorbing vibrations when force is applied to said upper further drumhead of said drumheads.

5. The muffling device for a drum of claim 4, further comprising a further substrate within said muffling device.

6. The muffling device for a drum of claim 4 further comprising a securing means comprising at least one fastener on said muffling device, said fastener joining said drumheads together.

* * * * *